US009308732B2

(12) United States Patent
Chua et al.

(10) Patent No.: US 9,308,732 B2
(45) Date of Patent: Apr. 12, 2016

(54) VENT FOR A LIQUID CONTAINER

(71) Applicant: HEWLETT-PACKARD DEVELOPMENT COMPANY, L.P., Houston, TX (US)

(72) Inventors: Boon Leng Chua, Singapore (SG); Sittampalam Paranan, Singapore (SG); Ping Siew Kwok, Singapore (SG); Swei Jen Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/424,108

(22) PCT Filed: Sep. 25, 2012

(86) PCT No.: PCT/US2012/057036
§ 371 (c)(1),
(2) Date: Feb. 26, 2015

(87) PCT Pub. No.: WO2014/051542
PCT Pub. Date: Apr. 3, 2014

(65) Prior Publication Data

US 2015/0328898 A1 Nov. 19, 2015

(51) Int. Cl.
*B41J 2/175* (2006.01)

(52) U.S. Cl.
CPC ..... *B41J 2/17513* (2013.01); *B41J 2/17553* (2013.01)

(58) Field of Classification Search
CPC ..... B41J 2/17553; B41J 2/17513
USPC ..... 347/86
See application file for complete search history.

(56) References Cited

U.S. PATENT DOCUMENTS

| | | | | |
|---|---|---|---|---|
| 3,582,285 | A * | 6/1971 | Hamilton | B01L 3/5085 206/461 |
| 4,491,433 | A * | 1/1985 | Shiurila | B41J 2/19 101/364 |
| 5,886,721 | A | 3/1999 | Fujii et al. | |
| 6,457,819 | B2 | 10/2002 | Santhanam | |
| 6,799,841 | B2 | 10/2004 | Iri et al. | |
| 7,384,137 | B2 | 6/2008 | Putman | |
| 7,871,156 | B2 | 1/2011 | Usui et al. | |
| 2001/0006397 | A1 | 7/2001 | Lim et al. | |
| 2011/0050820 | A1 | 3/2011 | Foster et al. | |

FOREIGN PATENT DOCUMENTS

| | | |
|---|---|---|
| EP | 0803365 | 10/1997 |
| JP | 2000043285 | 2/2000 |
| WO | WO-03022589 | 3/2003 |

* cited by examiner

*Primary Examiner* — Stephen Meier
*Assistant Examiner* — Alexander D Shenderov
(74) *Attorney, Agent, or Firm* — HP Inc. Patent Department

(57) ABSTRACT

In one example, a sealable vent for an ink cartridge or other liquid container includes a recess having a sloping first wall and a removable cover covering the recess and sealing the vent.

18 Claims, 11 Drawing Sheets

VENT FOR A LIQUID CONTAINER

BACKGROUND

Many inkjet ink cartridges include a vent to help maintain a desired pressure inside the cartridge. The vent is usually sealed prior to use to prevent ink evaporating or leaking from the cartridge. In some cases, the vent is sealed by an adhesive strip the user removes prior to installing the cartridge in a printer.

DRAWINGS

The same part numbers designate the same or similar parts throughout the figures.

DESCRIPTION

Figure 1:
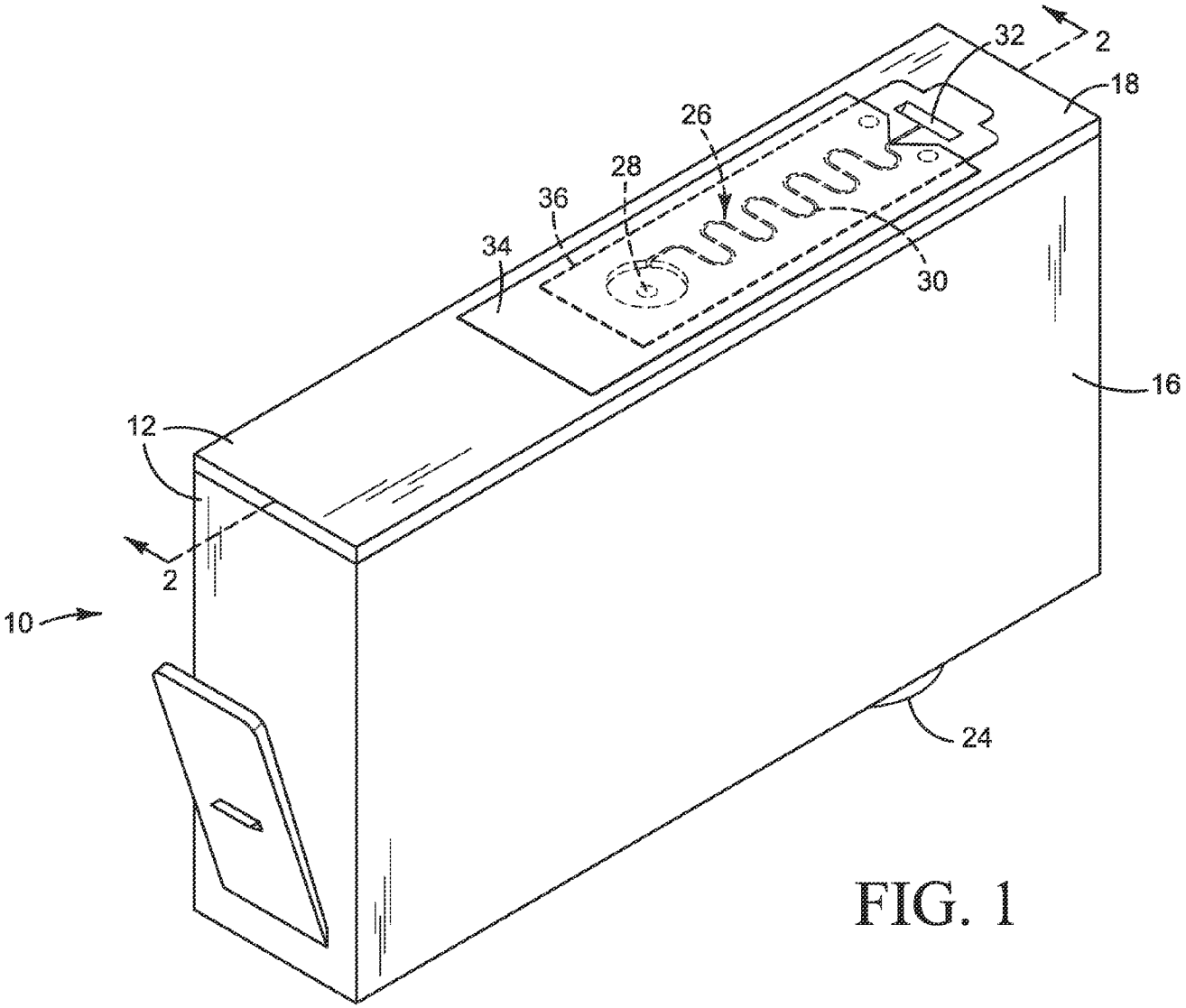
FIGS. 1-4 illustrate an ink cartridge implementing one example of a new vent inlet, in which the front wall of a rectangular inlet is sloped.
Figure 2:
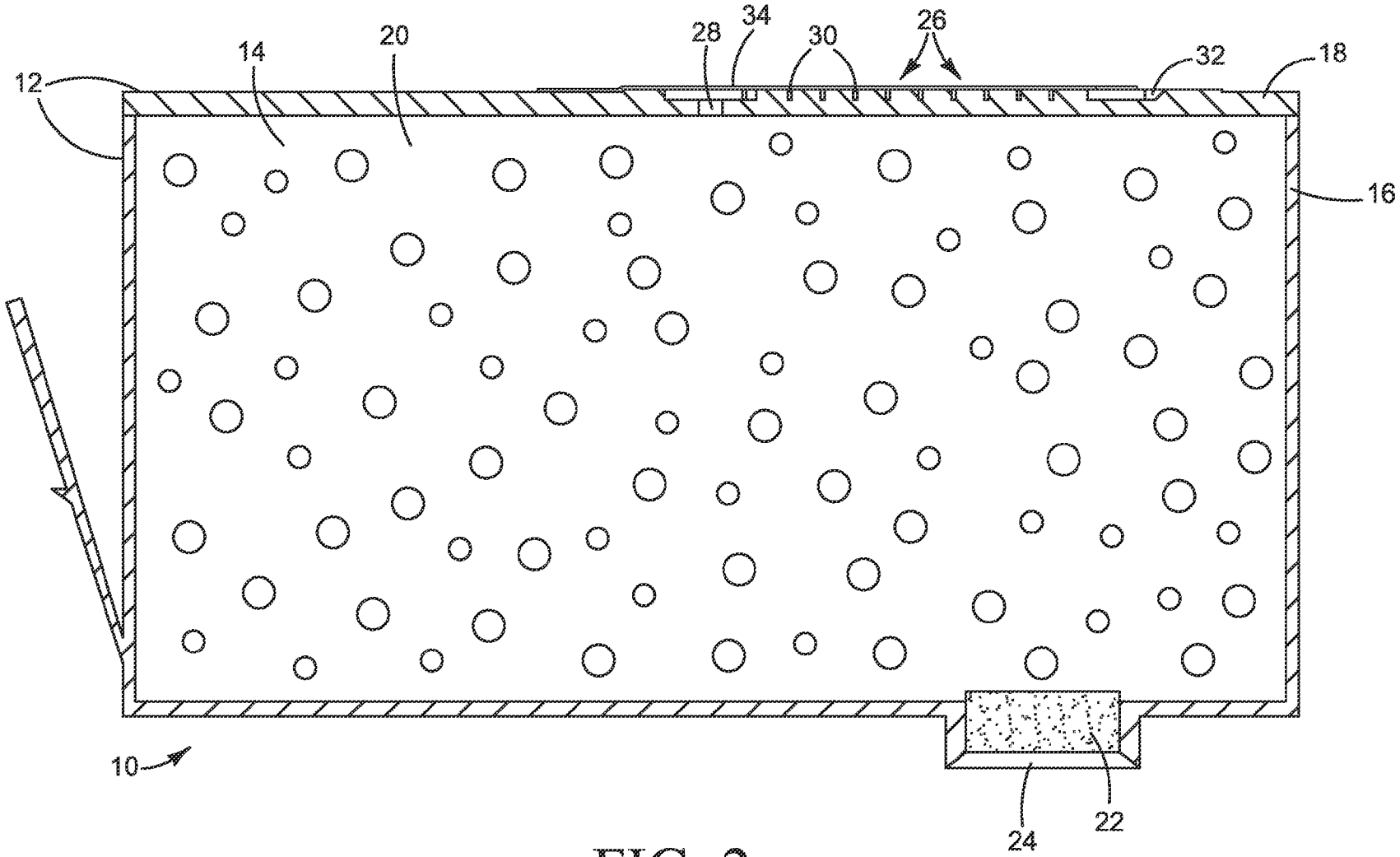

One configuration commonly used to vent ink cartridges includes a winding air channel that connects the vent opening to the atmosphere. The air channel terminates at a comparatively large inlet where air enters the channel. Prior to using the ink cartridge, an adhesive sealing strip is removed to expose the inlet, allowing air to enter the vent opening through the air channel. The winding air channel provides a long vent path in a compact space. The long vent path helps minimize ink evaporating from inside the cartridge. This type of vent is often called a "labyrinth" vent. The inlet in a conventional labyrinth vent is a narrow slot that intersects the air channel in the shape of a T and, accordingly, is commonly referred to as a "T slot."

For a conventional "T slot" inlet, the adhesive sealing strip does not always peel away cleanly from the inlet, leaving remnants or residue obstructing the inlet. It has been discovered that the removable part of the sealing strip is sometimes fused around and into the edge of the T slot when heat staking the strip to the ink cartridge. This unwanted fusing between the two parts can cause the sealing strip to not peel away cleanly from the T slot. A new vent inlet has been developed to help reduce the incidence of unwanted fusing and incomplete seal removal. It has been shown that a sloped front wall on a longer inlet slot, for example, helps the sealing strip peel away cleanly from the inlet of a labyrinth vent on an ink cartridge. Although examples of a new vent structure will be described with reference to the labyrinth vent on an ink cartridge for an inkjet printer, examples of the new vent structure are not limited to labyrinth vents or vents on ink cartridges in general but may be implemented in other types of vents.

FIGS. 1-4 illustrate an ink cartridge 10 implementing one example of a new vent inlet. Referring to FIGS. 1-4, ink cartridge 10 includes a housing 12 that forms an interior chamber 14 for holding ink. A typical ink cartridge housing 12 is formed in two (or more) molded plastic parts including, for example, a tub 16 and a cover 18 affixed to tub 16. Ink in chamber 14 is held in foam or another suitable capillary material 20. A wick 22 at cartridge outlet 24 is sometimes used to help control the flow of ink into the printhead assembly (not shown) when cartridge 10 is installed in a printer. FIGS. 1-4 illustrate just one type of ink cartridge in which examples of the new vent inlet might be implemented. Examples of the new vent inlet might also be implemented in other types of ink cartridges and liquid containers.

A vent 26 on cartridge 10 vents ink chamber 14 to the atmosphere. Vent 26 includes an opening 28 into ink chamber 14 through housing cover 18, a small winding channel 30, and an inlet 32 to channel 30. A vent cover 34 covers opening 28 and channel 30 so that air passes into and out of vent 26 primarily (or only) through inlet 32. Vent cover 34 is omitted from FIGS. 3 and 4 to better illustrate other features of vent 26. Vent cover 34 is usually a strip of adhesive material commonly referred to as a "label" because it is often printed with text or graphics. The area of housing cover 18 in which vent 26 is formed may be raised above the surrounding area in a platform 36 for more effectively attaching an adhesive label type vent cover 34.

As described below with reference to FIGS. 13-15, vent cover 34 is usually part of a two-piece adhesive strip 50 in which the part 52 (FIG. 13) covering vent inlet 32 is removed prior to using ink cartridge 10. However, an adhesive label 34 is just one example of a structure for covering vent opening 28 and channel 30 and vent cover 34 may be wholly separate from the removable inlet cover. Other structures are possible. For example, opening 28 and channel 30 might be passages fully enclosed within housing cover 18, thus making an adhesive label or other external vent cover 34 unnecessary. Also, an "adhesive" in this context includes thermal adhesives, pressure sensitive adhesives, and/or other materials and processes suitable for affixing vent cover 34 to housing cover 18.

Figure 3:
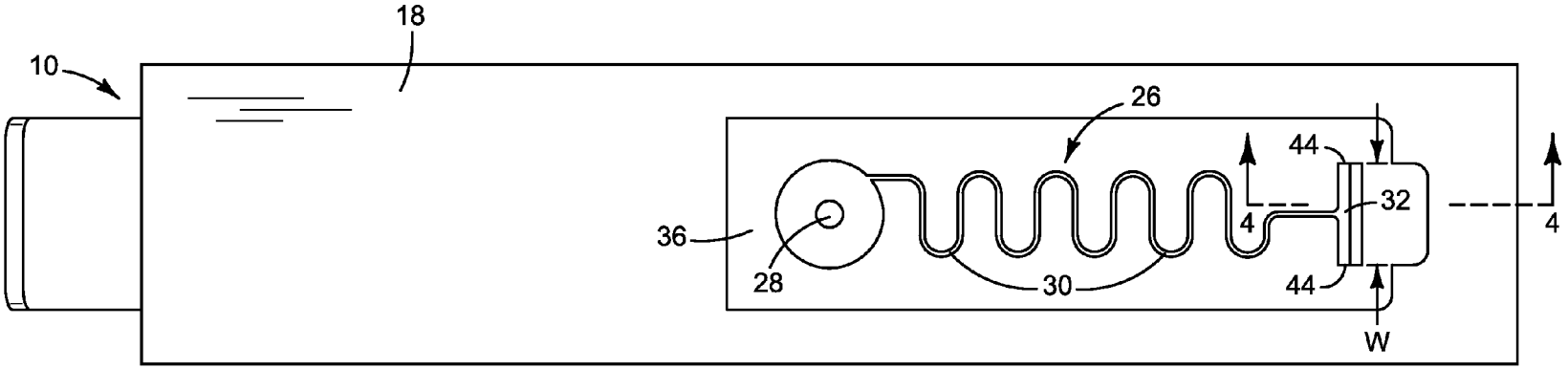
Figure 4:
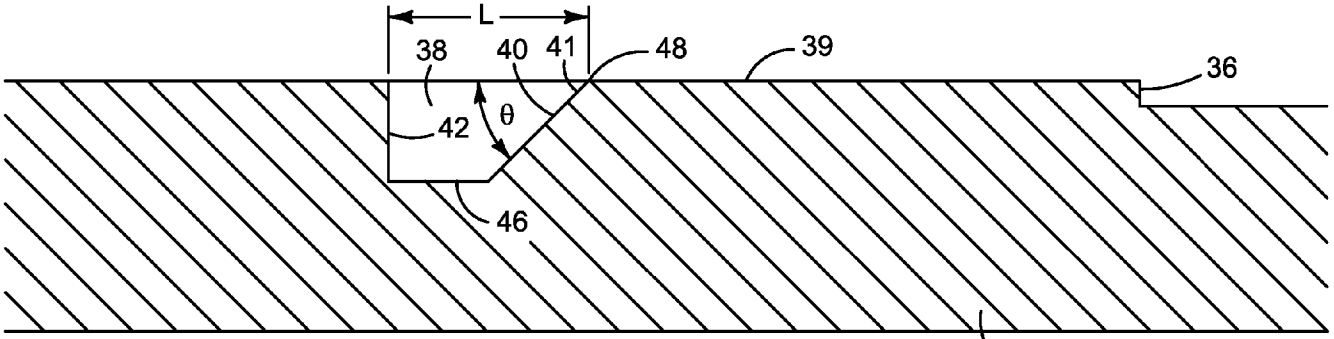

Referring now specifically to FIGS. 3 and 4, in the example shown, vent inlet 32 is a rectangular recess 38 in housing cover 18 defined by a front wall 40, a rear wall 42, side walls 44, and a floor 46. Front and rear walls 40 and 42 are also referred to as leading and trailing walls 40 and 42, respectively, in relation to the direction an adhesive strip of sealing material is removed from cartridge 10, as described below with reference to FIGS. 13-15. A sloping part 41 of leading wall 40 intersects the surface 39 of housing cover 18 into which recess 38 recedes and declines at an angle $\Theta$ substantially less than 90° to present a gradual transition to an adhesive sealing strip as it is peeled from cover 18 along inlet 32, rather than the abrupt transition presented by a sheer, vertical wall in a conventional T slot inlet. Also, recess 38 is longer than a conventional T slot. For example, a new recess 38 for an ink cartridge 10 such as that shown in FIGS. 1-4 is about1.6 mm long (length L in FIG. 4) compared to a conventional T slot that is only about 0.8 mm long.

Testing indicates that a longer recess 38 with a declined leading wall 40 significantly reduces the incidence of incomplete seal removal at vent inlet 32 compared to a conventional, shorter T slot with a vertical wall. A sloped front wall 40 eliminates the abrupt leading part of a vertical front wall to prevent, or at least inhibit, inlet cover 52 (FIG. 13) melting over and into the edge of housing cover 18 along leading part 48 during heat staking, and thus allows the removable inlet cover to peel away more cleanly from housing cover 18. Also, the larger "footprint" area of recess 38 compared to a conventional T slot helps ensure that the separation force generated when the user peels back the removable inlet cover 52 (FIG. 13) is sufficient to overcome the adhesive bond between vent cover 34 and housing cover 18. It has been shown that a rectangular recess 38 about 1.6 mm long (L in FIG. 4) and about 5.6 mm wide (W in FIG. 3) with a leading wall 40 sloped at angle ⊖ of 45° reduces the vent fail rate to less than ⅓ that of a conventional T slot. More generally, testing suggests that, where recess 38 is about 1.6 mm to 2.8 mm long, a slope angle ⊖ in the range of 30° to 45° will significantly reduce the risk of a blocked vent inlet 32 compared to a conventional vent inlet.

Figure 5:
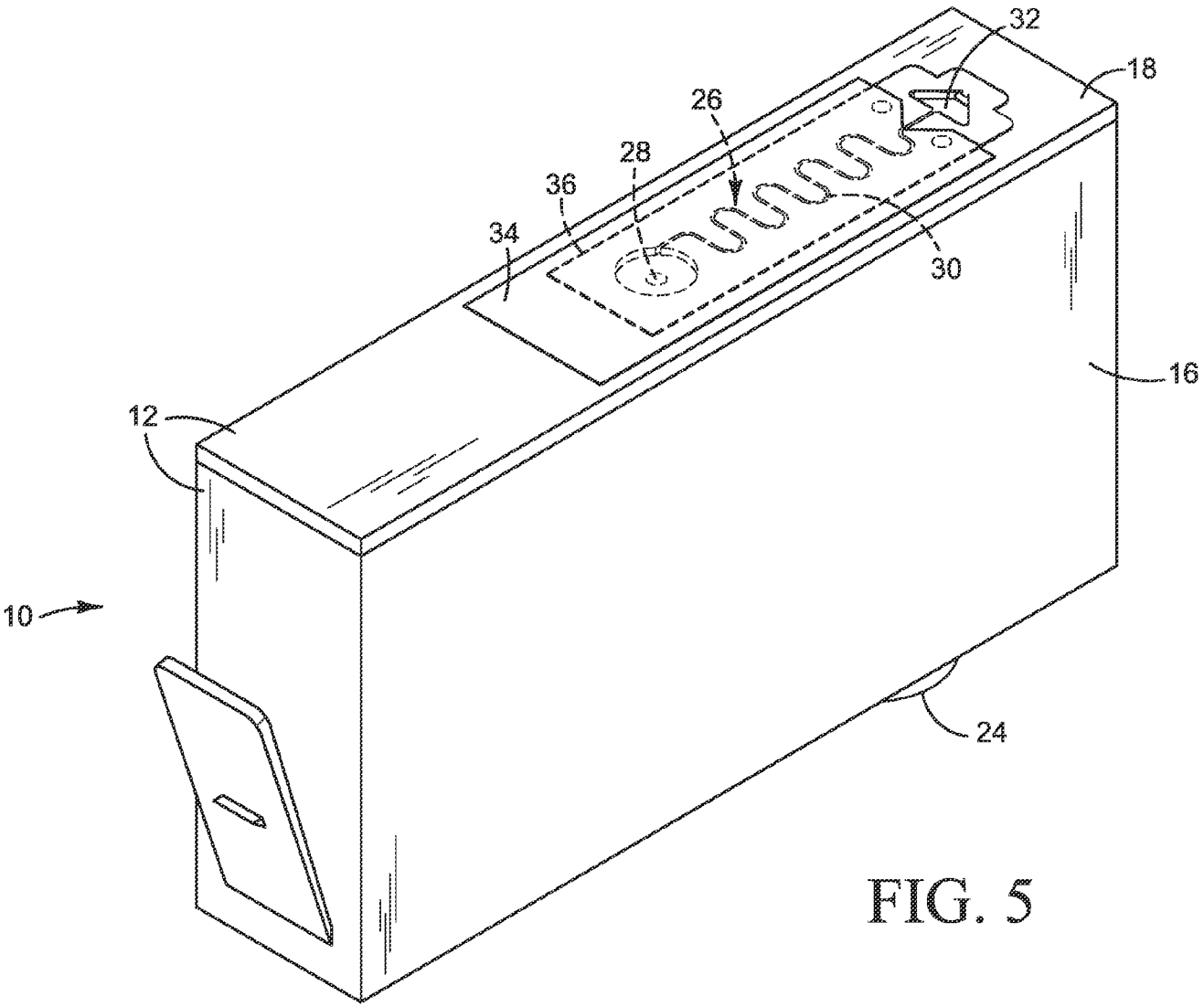
FIGS. 5-7 illustrate an ink cartridge implementing another example of a new vent inlet, in which the inlet is elongated in the shape of a truncated triangle and the leading part of the front wall is curved.
Figure 6:
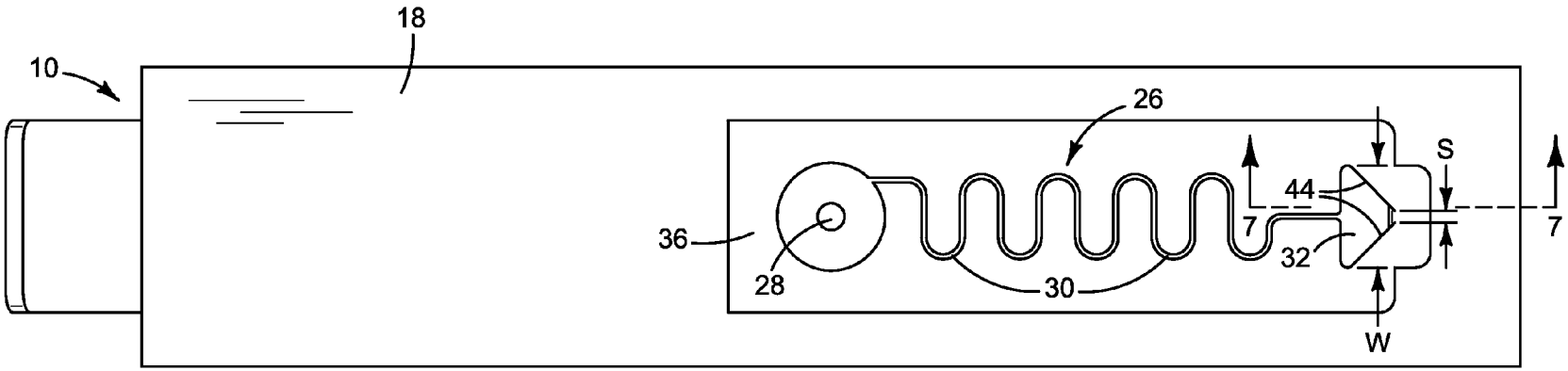
Figure 7:
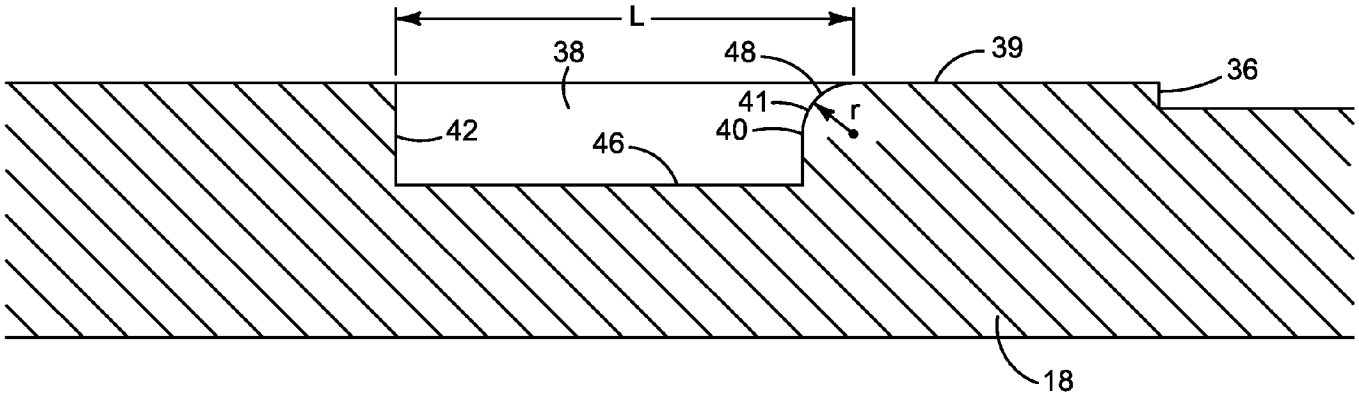
Figure 8:
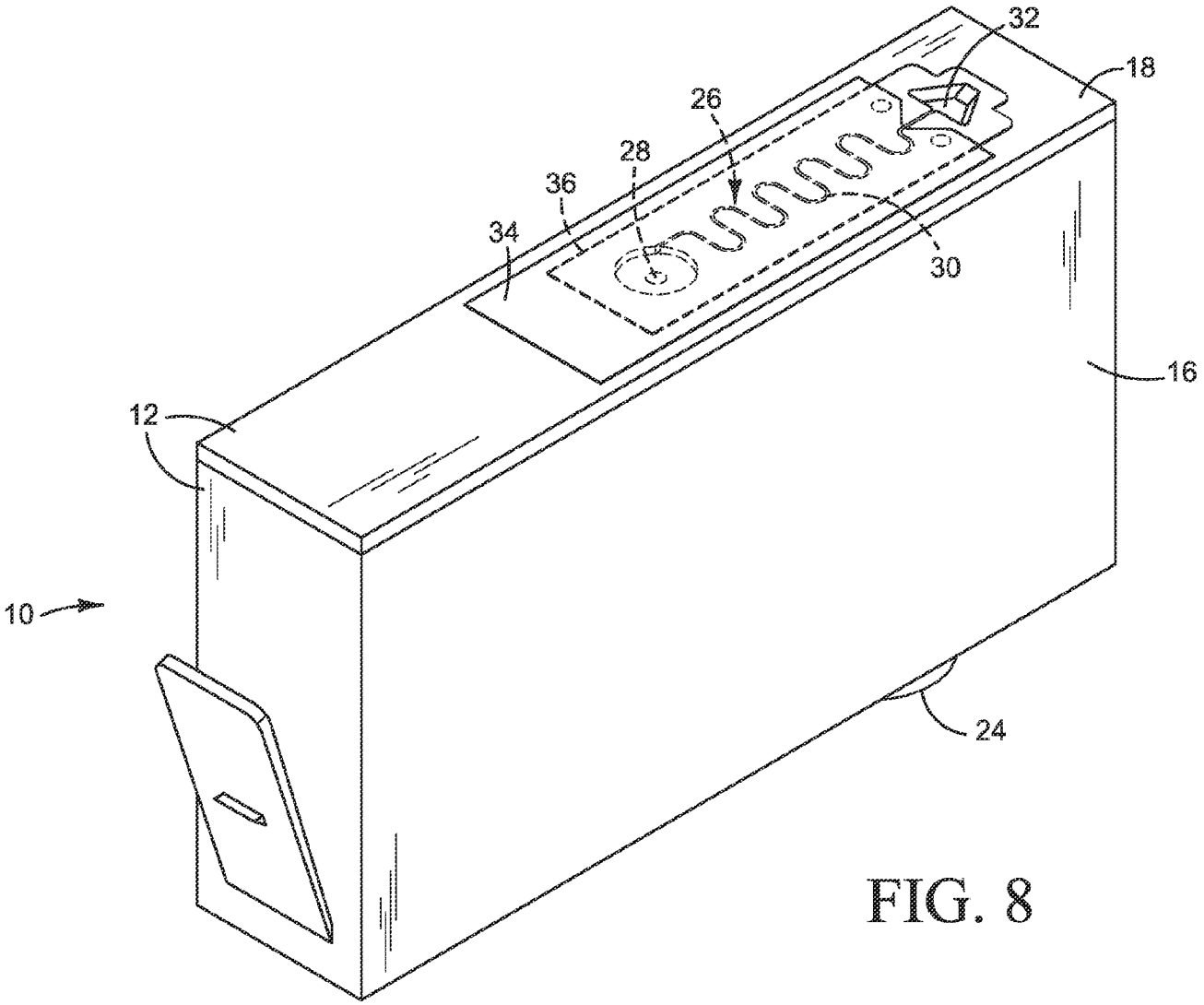
FIGS. 8-11 illustrate an ink cartridge implementing another example of a new vent inlet, in which the inlet is elongated in the shape of a truncated triangle and the front and side walls are sloped.
Figure 9:
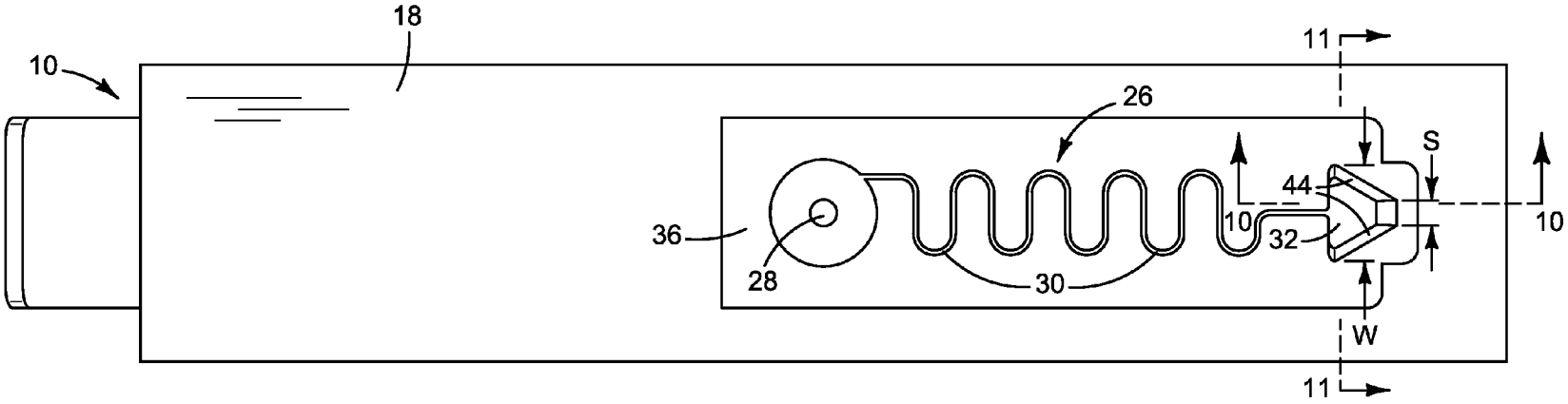
Figure 10:
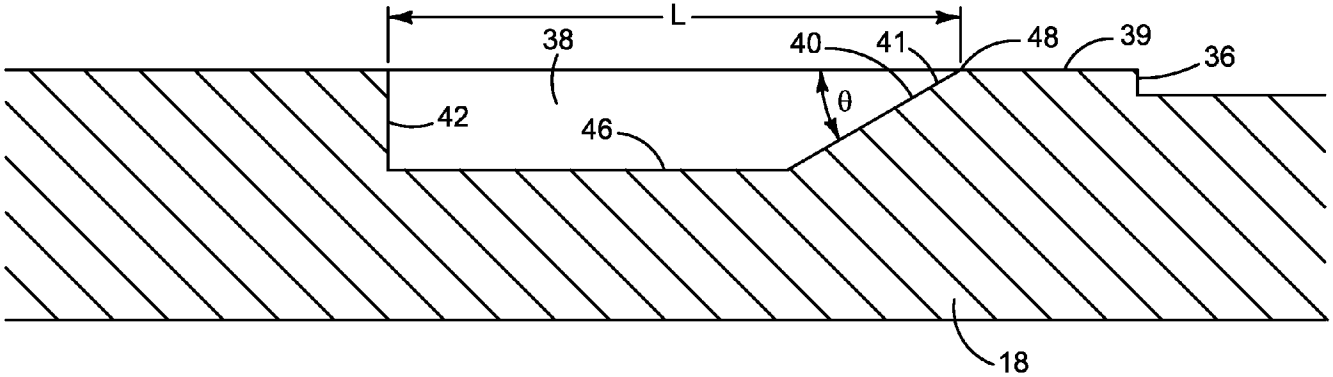
Figure 11:
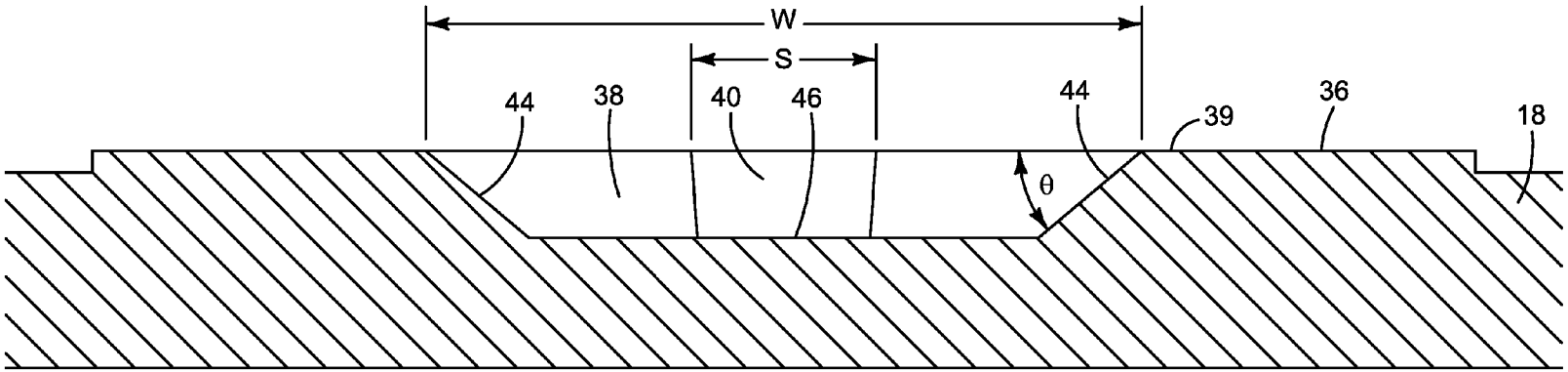

FIGS. 5-7 illustrate a second example of a new vent inlet 32. Referring to FIGS. 5-7, in this example vent inlet 32 is a quadrangular recess 38 in the shape of a truncated triangle. Recess 38 is defined by a front wall 40, a rear wall 42, diverging side walls 44, and a floor 46. (Side walls 44 diverge in the direction the adhesive sealing strip is peeled off housing cover 18.) The length of recess 38 is extended further in the peel direction compared to the example shown in FIGS. 1-4 and leading part 48 is curved at the transition from the surface 39 of housing cover 18 to an otherwise vertical front wall 40.

Testing indicates that a longer, truncated triangular shaped recess 38 with a curved leading part 48, as shown in FIGS. 5-7, significantly reduces the incidence of incomplete seal removal at vent inlet 32 compared to a conventional T slot. A curved leading part 48 eliminates the abrupt edge of an otherwise vertical front wall 40 to prevent, or at least inhibit, removable inlet cover 52 (FIG. 13) melting over and into the edge of housing cover 18 along leading part 48 during heat staking, and thus allows inlet cover 52 (FIG. 13) to peel away more cleanly from housing cover 18. Also, a narrower front wall 40 reduces the separation force needed at leading part 48 and the larger "footprint" area of recess 38 helps ensure that the separation force generated as the user peels back inlet cover 52 (FIG. 13) is sufficient to overcome the adhesive bond between housing and vent covers 18 and 34. For example, it has been shown that a recess 38 having a length L of about 2.8 mm, a width W of about 5.6 mm, a snout width S of about 1.0 mm and with a vertical front wall 40 and a leading part 48 curved to a radius "r" of 0.5 mm also reduces the vent fail rate to less than ⅓ that of a conventional T slot.

FIGS. 8-11 illustrate another example of a new vent inlet 32 that combines advantageous features from the examples described above. Referring to FIGS. 8-11, vent inlet 32 is elongated in the shape of a truncated triangle with sloped leading and side walls 40 and 44. In the example shown, leading wall 40 declines at an angle ⊖ of 30° and each side wall 44 declines at an angle Φ of 45°. In addition to the advantages noted above for a sloped leading wall 40 and a truncated triangular shaped recess 38, sloped side walls 44 eliminate the abrupt edge of vertical side walls to further limit the risk of an adhesive inlet cover 52 (FIG. 13) melting around and in to the edges of recess 38. (Although further advantage might be obtained from a sloped rear/trailing wall 42, the connection to channel 30 and mold limitations make it difficult to fabricate a sloped rear wall 42.) Testing suggests that for the configuration of recess 38 shown in FIGS. 8-11, a length L of 2.8 mm to 3.8 mm (width W about 5.6 mm and snout width S about 1.0 mm) and slope angles ⊖ and Φ of 30° to 45° will significantly reduce the risk of a blocked vent inlet 32 compared to a conventional vent inlet and compared to the configurations shown in FIGS. 1-4 and 5-7.

Figure 12:
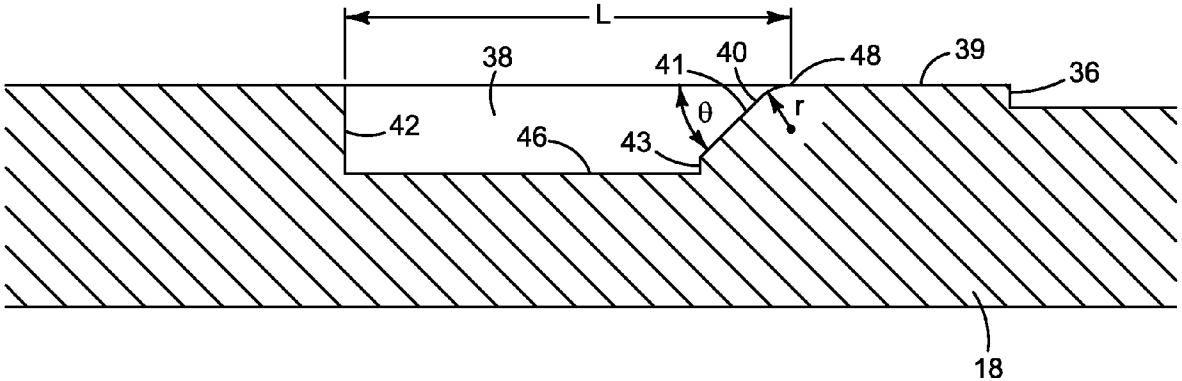
FIG. 12 illustrates a variation on the inlet configuration shown in FIGS. 8-11 in which the sloped front wall includes a curved leading part and a vertical part that intersects the floor of the inlet.

The section view of FIG. 12 illustrates one possible variation of the configuration shown in FIGS. 8-11, in which front wall 40 is sloped but not along its full length. In the example of FIG. 12, a curved leading part 48 transitions from the surface 39 of housing cover 18 to a sloped part 41 of front wall 40. Wall 40 also includes a vertical part 43 that intersects the floor 46 of recess 38.

Figure 13:
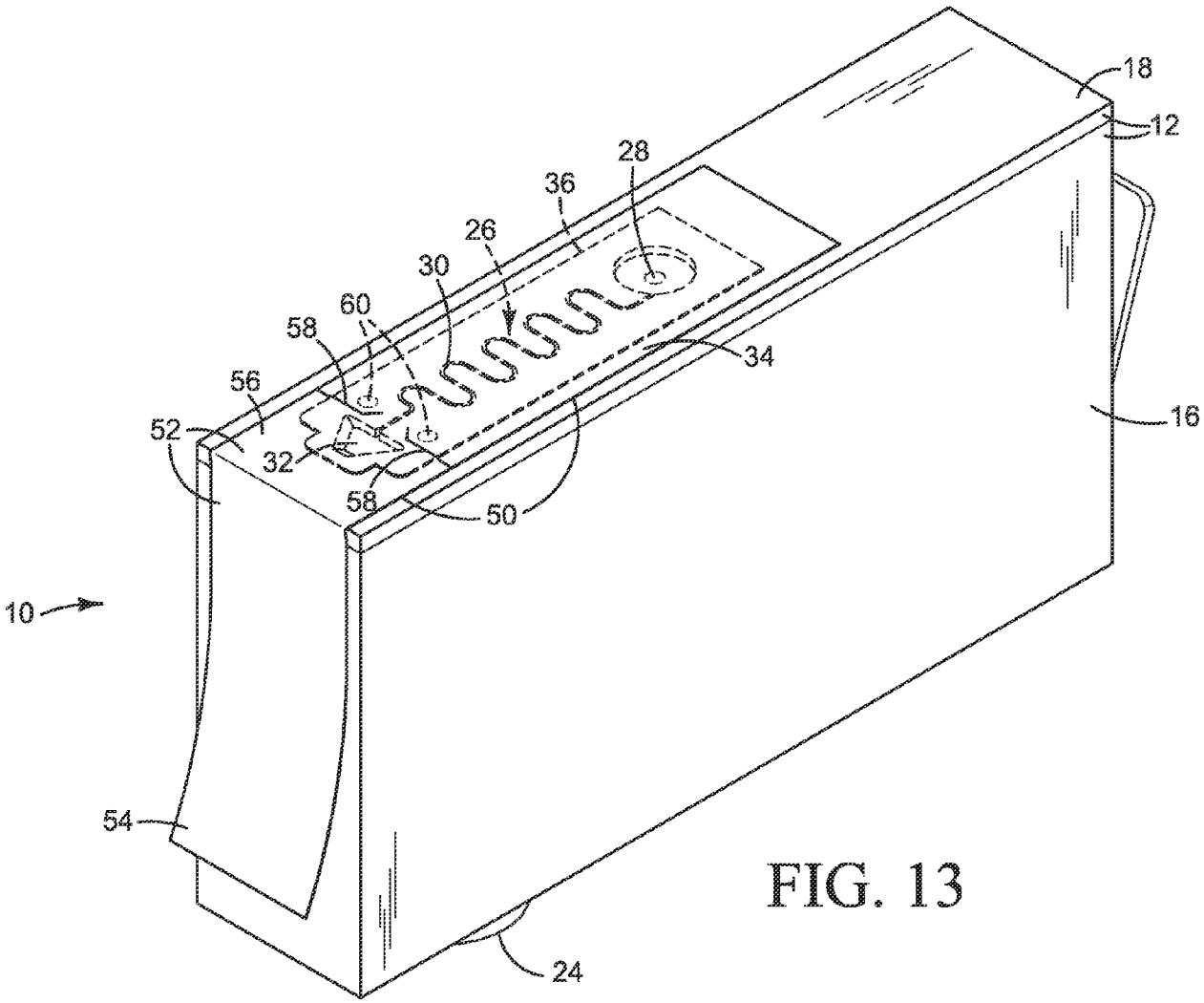
FIGS. 13-15 illustrate the removal of an adhesive sealing strip from the ink cartridge and vent inlet shown in FIGS. 8-11.
Figure 14:
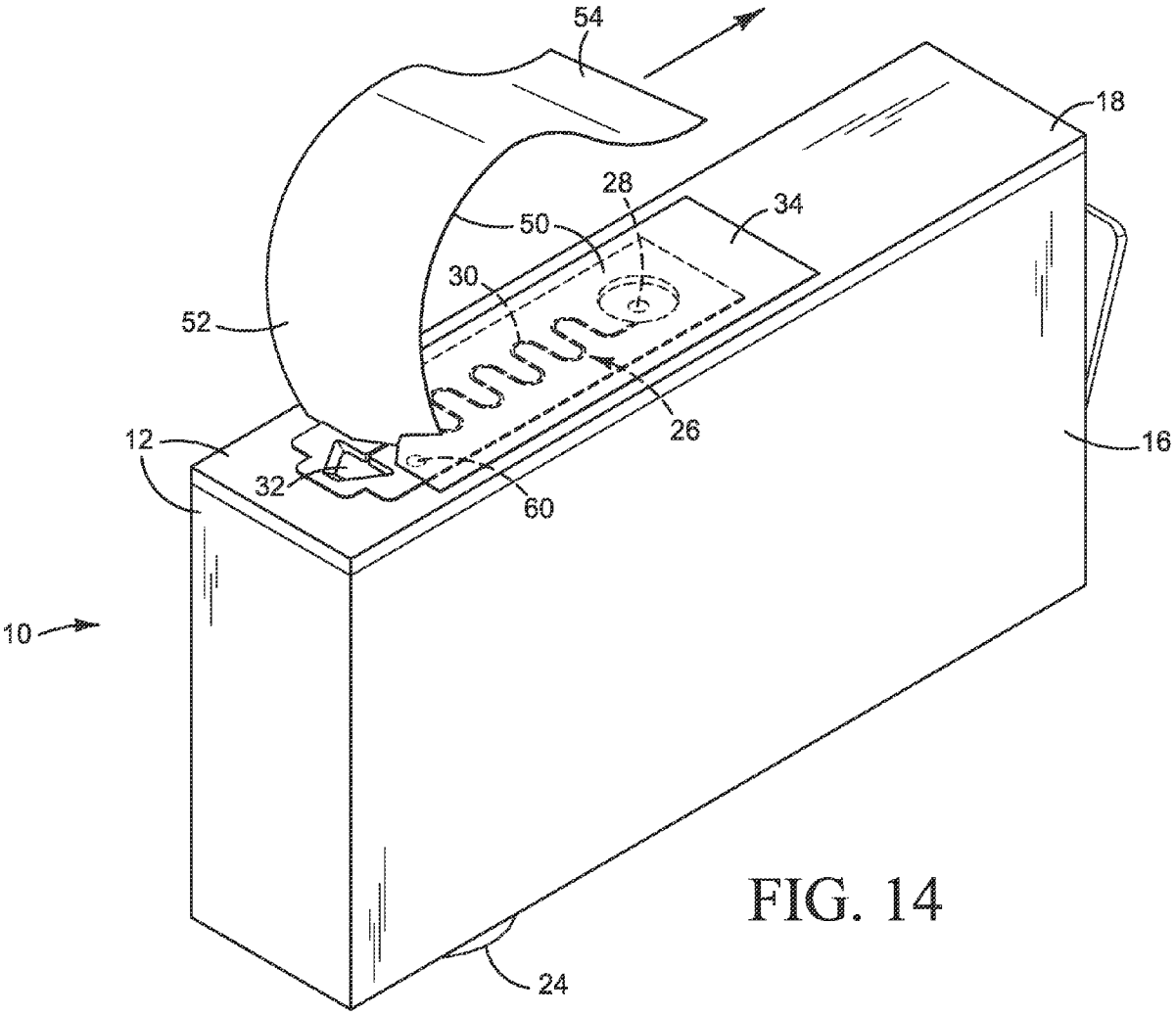
Figure 15:
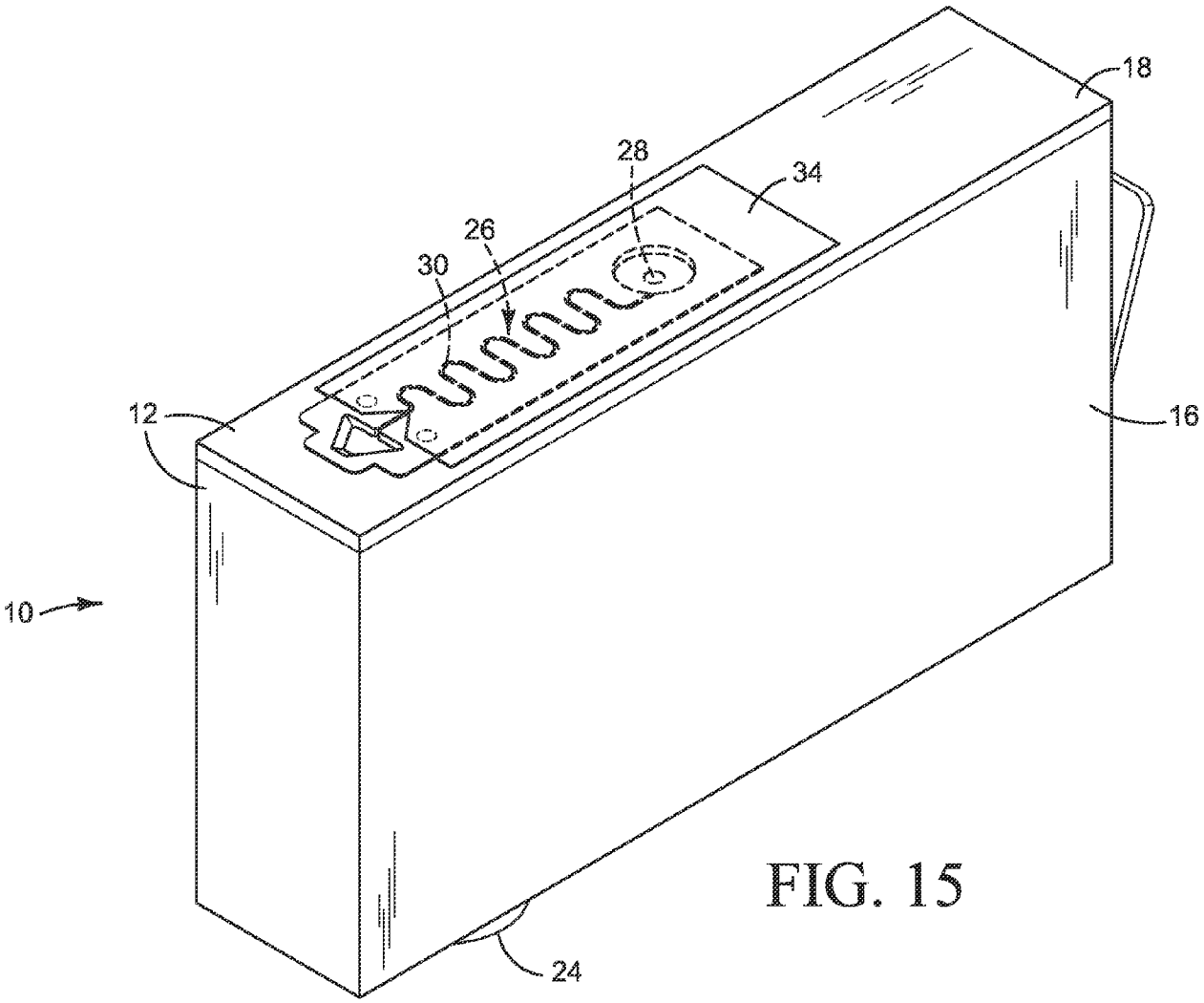

FIGS. 13-15 illustrate the removal of an adhesive sealing strip 50 from an ink cartridge 10 with a vent inlet 32 such as that shown in FIGS. 8-11. Referring to FIGS. 13-15, adhesive sealing strip 50 includes a first, removable part 52 that covers inlet 32 and a second non-removable part 34 that covers opening 28 and channel 30. Removable part 52 includes a first, free end 54 and a second end 56 that seals vent inlet 32. A user grasps the free end 54 of strip 50 and peels it back to remove part 52 and uncover vent inlet 32, exposing cartridge vent 26 to the atmosphere, as best seen by comparing FIGS. 13, 14 and 15. Tear-slits or perforations 58 in sealing strip 50 help make a clean break at the desired location between removable and non-removable parts 52 and 34. Also, the non-removable part 34 of sealing strip 50 is heat staked to housing cover 18 near the joint with removable part 52 to prevent dislodging the end of non-removable part 34 when removable part 52 is peeled off cover 18, as indicated by heat stakes 60 in FIGS. 13-15.

The examples shown in the figures and described above illustrate but do not limit the invention. Other examples may be made and implemented. Therefore, the foregoing description should not be construed to limit the scope of the invention, which is defined in the following claims.

What is claimed is:

1. A sealable vent for a liquid container, the vent including a recess having a sloping first wall and a removable cover covering the recess and sealing the vent, a sloping part of the first wall intersecting a surface of the container into which the recess recedes at an angle substantially less than 90° measured between the sloping part of the wall and a plane of the surface.

2. The vent of claim 1, where the angle is 30° to 45°.

3. The vent of claim 1, where a leading part of the first wall is curved into the slope.

4. The vent of claim 1, where the first wall is sloped along its full length.

5. The vent of claim 1, where the recess comprises a quadrangular recess having the first wall, a second wall opposite the first wall, and opposing third and fourth walls diverging from one another from the first wall to the second wall so that the recess is shaped like a truncated triangle.

6. The vent of claim 5, where each of the third and fourth walls comprises a sloping wall.

7. A vent for a liquid container having a housing defining a chamber therein for storing liquid, the vent comprising:

an opening through the housing and into the chamber;

a recess in the housing completely spaced apart from the opening such that no part of the opening overlaps any part of the recess; and a channel extending from the recess to the opening;

the recess including a first wall and a second wall opposite the first wall and one or both of:

at least part of the first wall is sloped in a direction up and away from the second wall; and the recess comprises a quadrangular recess that also includes opposing third and fourth walls diverging from one another from the first wall to the second wall so that the recess is shaped like a truncated triangle.

8. The vent of claim 7, further comprising a cover covering the opening and most or all of the channel.

9. The vent of claim 7, further comprising an adhesive cover covering the opening, the channel and the recess, the adhesive cover including a first part covering the opening and most or all of the channel and a removable second part covering the recess.

10. The vent of claim 7, where the recess comprises the quadrangular recess and at least part of the first wall is sloped in a direction up and away from the second wall at an angle of 30° to 45° measured with respect to a surface of the housing into which the recess recedes.

11. The vent of claim 10, where the third and fourth walls are sloped an angle of 30° to 45° measured with respect to the surface of the housing into which the recess recedes.

12. The vent of claim 7, where a sloping part of the first wall intersects a surface of the housing into which the recess recedes at an angle substantially less than 90° measured between the sloping part of the wall and a plane of the surface.

13. The vent of claim 12, where the angle is 30° to 45°.

14. The vent of claim 12, where the channel extends along a surface of the housing between the opening and the recess.

15. An ink cartridge for an inkjet printer, comprising:

a housing defining a chamber therein for storing ink;

a vent through which air may pass into and out of the ink chamber, the vent having an opening through the housing into the ink chamber, a quadrangular recess in the housing, and a winding channel connecting the opening and the recess, the recess having a front wall and a rear wall, the channel intersecting the recess at the rear wall and the front wall sloping in a direction up and away from the rear wall; and an adhesive cover covering the opening.

16. The ink cartridge of claim 15, wherein the adhesive cover includes a first part covering the opening and a removable second part covering the recess.

17. The ink cartridge of claim 16, where the recess includes side walls diverging from one another from the front wall to the rear wall so that the recess is shaped like a truncated triangle.

18. The ink cartridge of claim 16, where the front wall and each side wall slopes at an angle of 30° to 45° measured with respect to the surface of the housing into which the recess recedes.

* * * * *